US009157264B2

(12) United States Patent
Bortoluzzi et al.

(10) Patent No.: US 9,157,264 B2
(45) Date of Patent: Oct. 13, 2015

(54) DEVICE FOR SLIDING DOOR LEAVES WITH CO-PLANAR CLOSURE, PARTICULARLY FOR FURNITURE AND THE LIKE

(75) Inventors: Guido Bortoluzzi, Belluno (IT); Adriano Girotto, Villorba (IT); Bruno Sponga, Belluno (IT); Rodolfo Dal Castel, Santa Giustina Bellunese (IT)

(73) Assignee: BORTOLUZZI LAB S.R.L., Belluno (IT)

( * ) Notice: Subject to any disclaimer, the term of this patent is extended or adjusted under 35 U.S.C. 154(b) by 0 days.

(21) Appl. No.: 14/119,064

(22) PCT Filed: Mar. 16, 2012

(86) PCT No.: PCT/EP2012/054724

§ 371 (c)(1),
(2), (4) Date: Nov. 20, 2013

(87) PCT Pub. No.: WO2012/159785

PCT Pub. Date: Nov. 29, 2012

(65) Prior Publication Data

US 2014/0082886 A1 Mar. 27, 2014

(30) Foreign Application Priority Data

May 23, 2011 (IT) ..... TV2011A0071

(51) Int. Cl.

| | |
|---|---|
| ***A47B 88/00*** | (2006.01) |
| ***E05D 15/06*** | (2006.01) |
| ***E05D 15/10*** | (2006.01) |

(52) U.S. Cl.

CPC ..... *E05D 15/063* (2013.01); *E05D 15/1042* (2013.01); *E05D 2015/1055* (2013.01); *E05Y 2201/412* (2013.01); *E05Y 2201/488* (2013.01); *E05Y 2201/626* (2013.01); *E05Y 2201/64* (2013.01); *E05Y 2201/692* (2013.01); *E05Y 2800/73* (2013.01); *E05Y 2900/20* (2013.01); *Y10T 16/381* (2015.01)

(58) Field of Classification Search

CPC .. E05D 15/063; E05D 15/1042; Y10T 16/381
USPC ..... 49/213, 216, 218, 221, 223, 225, 425, 49/409, 410, 125, 127, 128, 129, 130; 16/87 R, 87 B; 312/295, 310, 311
See application file for complete search history.

(56) References Cited

U.S. PATENT DOCUMENTS

| | | | | |
|---|---|---|---|---|
| 4,644,690 | A * | 2/1987 | Caimi | 49/130 |
| 4,949,504 | A * | 8/1990 | Bortoluzzi | 49/130 |
| 6,336,246 | B1 * | 1/2002 | Giovannetti | 16/87 R |
| 7,647,728 | B2 * | 1/2010 | Bortoluzzi | 49/209 |
| 8,763,205 | B2 * | 7/2014 | Schmidhauser et al. | 16/92 |

FOREIGN PATENT DOCUMENTS

| | | | |
|---|---|---|---|
| CN | 1802486 | A | 7/2006 |
| EP | 0712989 | A1 | 5/1996 |
| FR | 2603939 | A1 | 3/1988 |
| WO | 2007074397 | A2 | 7/2007 |
| WO | 2009043701 | A1 | 4/2009 |

* cited by examiner

*Primary Examiner* — Jerry Redman
(74) *Attorney, Agent, or Firm* — Lando & Anastasi LLP

(57) ABSTRACT

A device for sliding door leaves with co-planar closure, particularly for furniture, includes a bracket system for connection with each one of the door leaves. A first pair of wheels is associated with the bracket system in a downward region. The device includes elements adapted to force the closure arrangement of at least one of the door leaves.

4 Claims, 7 Drawing Sheets

DEVICE FOR SLIDING DOOR LEAVES WITH CO-PLANAR CLOSURE, PARTICULARLY FOR FURNITURE AND THE LIKE

BACKGROUND OF THE INVENTION

The present application relates to a device for sliding door leaves with co-planar closure, particularly for furniture and the like.

Nowadays as an alternative to normal hinged doors, sliding door solutions are known that can be applied both to wardrobes and furniture in general and to door and window frames or to any other application of closing elements that require a reduced space in their open position.

Generally these types of doors are constituted by two or more door leaves, each one of which has brackets with rolling means guided by a rail, which is constituted by an upper guide and by a lower guide, respectively applied to the floor and to the ceiling of the space to be closed, the rail of one door leaf being adjacent and parallel to the rail of the other door leaf.

The sliding of the door leaves in this type of door thus occurs on parallel and adjacent planes which achieve the closure of the space by the alignment or partial overlapping of the edges of one door leaf with the edges of the other door leaf and with the mutually opposite edges of both door leaves against the edges or the jambs of the space to be closed.

The unaesthetic quality of sliding doors which in the closed condition are seen as arranged on two different planes, although parallel and close together, in particular in furniture where aesthetics assume considerable importance, has led the technique of the field to seek solutions that provide the co-planarity of the two door leaves, when they are closed, whereas also ensuring their overlapping when they are open.

According to this consolidated technique, co-planarity of the door leaves is obtained during closing, although with different devices of greater or lesser complexity, involving, for each door leaf, a step of entrainment, along the respective parallel rails, and a step of pushing for the translational motion thereof into the adjacent bottom rail, the other end of which already supports and guides the other door leaf with which to align the door leaf in movement.

Italian patent for invention no. 1.208.152, for achieving co-planarity, is known, which uses an entrainment device in which for each door leaf a pair of sliding guides is provided, by means of adapted brackets and respective sliding elements, each one of such pairs of guides comprising a rectilinear front guide and a second rear guide with curved end portion, while the first guide is provided with a part that branches out at right angles and is directed toward the the second guide, so as to enable the translational motion of corresponding sliding elements of the corresponding door leaf, by simple translational motion of the door leaf to be moved.

However, even the relative constructional simplicity of the sliding doors solution proposed by the above-mentioned patent has exhibited a complexity in the construction and assembly thereof, as well as a certain encumbrance of the supporting structure and translational motion of the door leaves.

In particular it has been found that the encumbrance of the bracket systems and of the lower trackways leads to failure to use part of the piece of furniture on which these sliding doors are applied.

A severe drawback which is ascribable to such known art consists in that in order to achieve the closing of the door leaf, the user must apply a certain amount of force which, in the final step of closing, causes the rapid movement of the door leaf on the piece of furniture with consequent heavy impact between the components. In addition to a bothersome noise, this causes damage to the components over time.

BRIEF SUMMARY OF THE INVENTION

The aim of the present invention is therefore to solve the above-mentioned technical problems, eliminating the drawbacks in the cited known art, by providing a device that, applied to door leaves which can slide, not only makes it possible to achieve the co-planarity of the door leaves during closing and their overlapping arrangement on both sides of the piece of furniture during opening, makes it possible to achieve easy closing that is free from violent impacts between door leaf and piece of furniture.

Within this aim, an object of the invention is to provide a device in which the door leaves are protected, in the closing movement thereof, from possible damage and impact with the piece of furniture, all without requiring any direct intervention by the user.

Another object is to provide a device that is constructionally simple, easy to maintain and has a low number of components.

This aim and these and other objects which will become more apparent hereinafter are achieved by a device for sliding door leaves with co-planar closure, particularly for furniture, comprising a bracket system for interconnection with each one of said door leaves, characterized in that it comprises means adapted to force the closure arrangement of at least one of said door leaves.

BRIEF DESCRIPTION OF THE DRAWINGS

Further characteristics and advantages of the invention will become more apparent from the detailed description of a specific, but not exclusive, embodiment, illustrated by way of non-limiting example in the accompanying drawings, wherein.

DETAILED DESCRIPTION OF THE INVENTION

Figure 1:
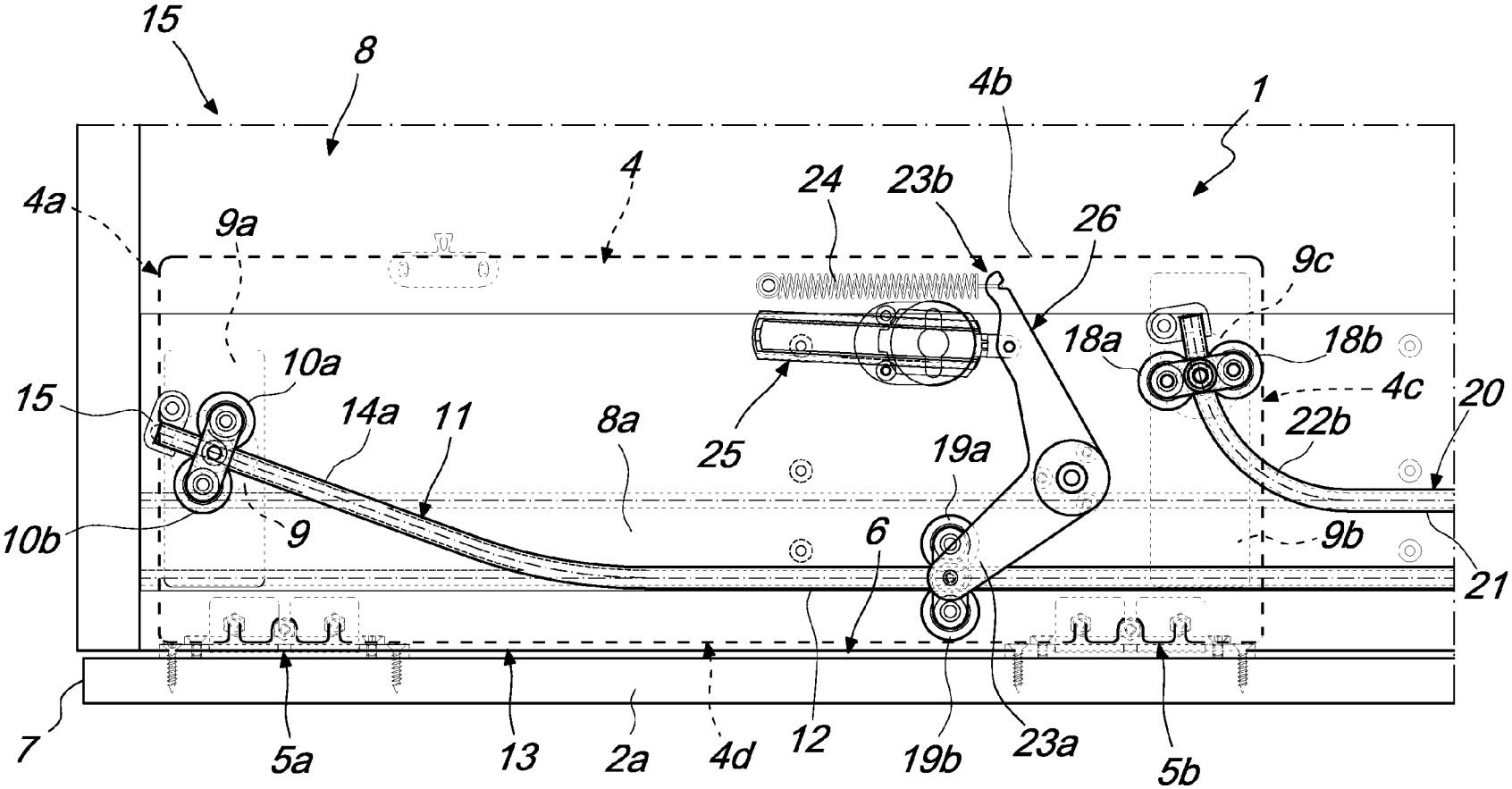
FIG. 1 is a a plan view of a first, left-hand half of a piece of furniture with two door leaves with the device applied.
Figure 2:
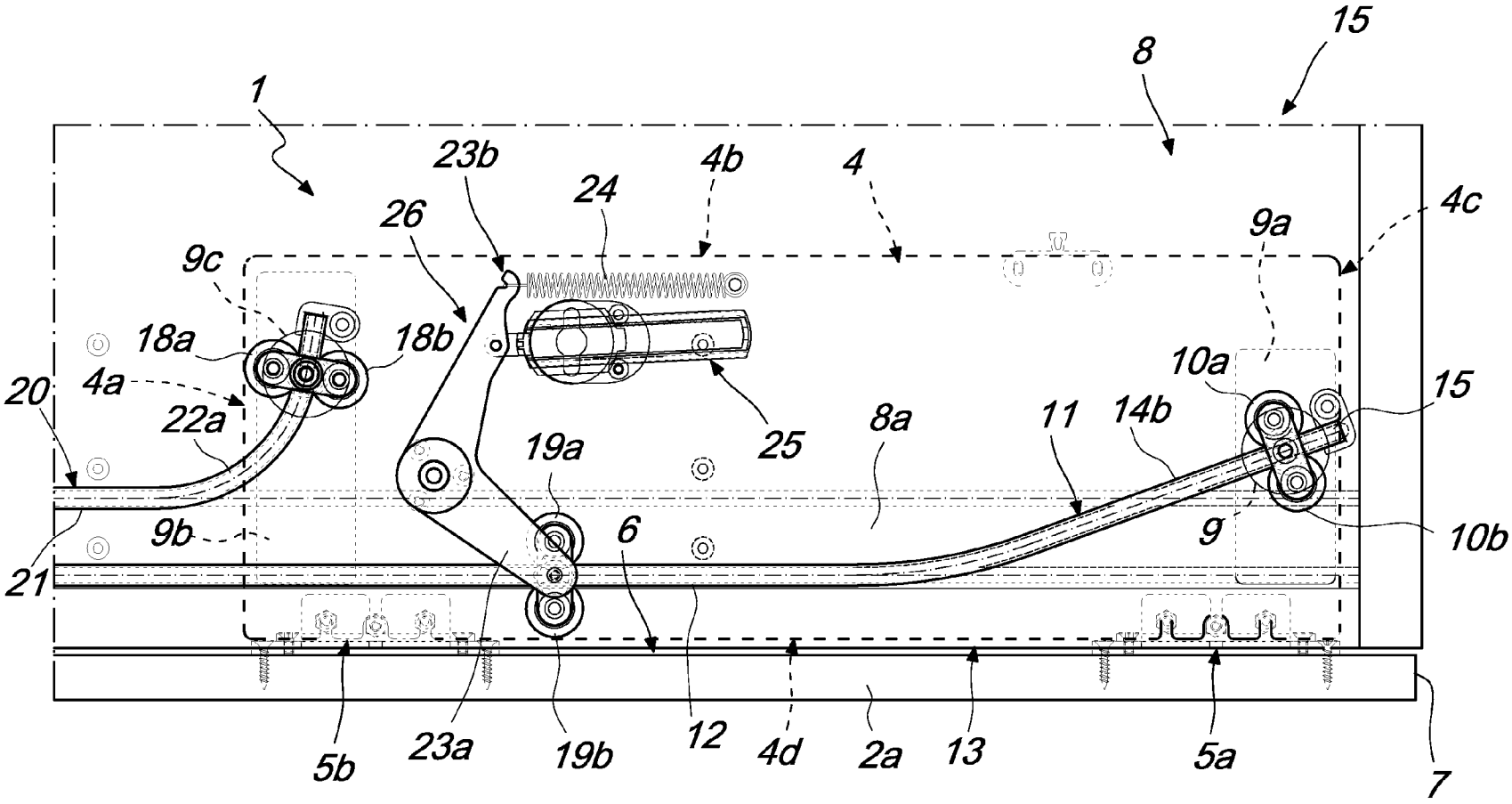
FIG. 2 is a a plan view of a second, right-hand half of a piece of furniture with two door leaves with the device applied.
Figure 3:
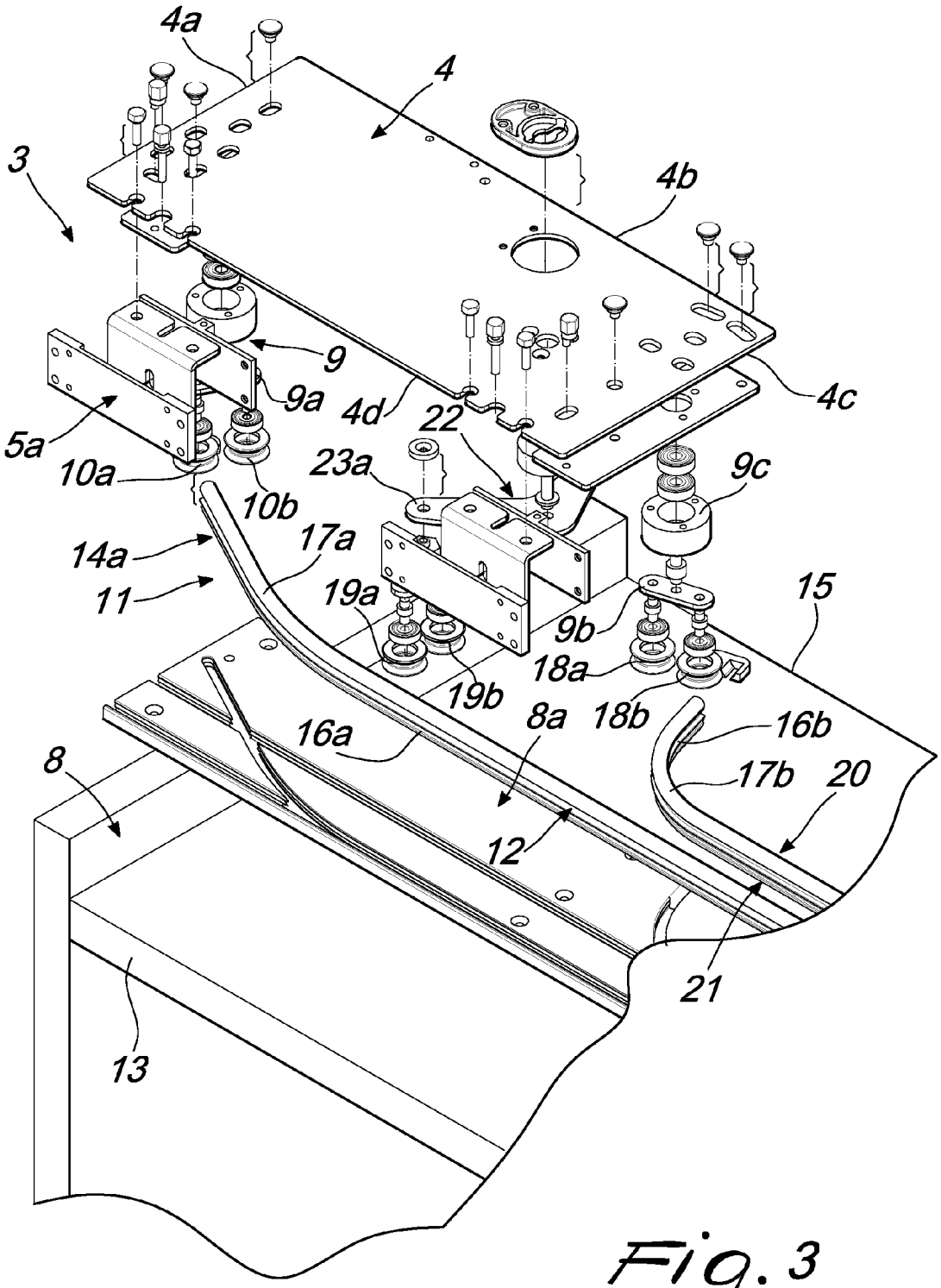
FIG. 3 is a first exploded perspective view.
Figure 4:
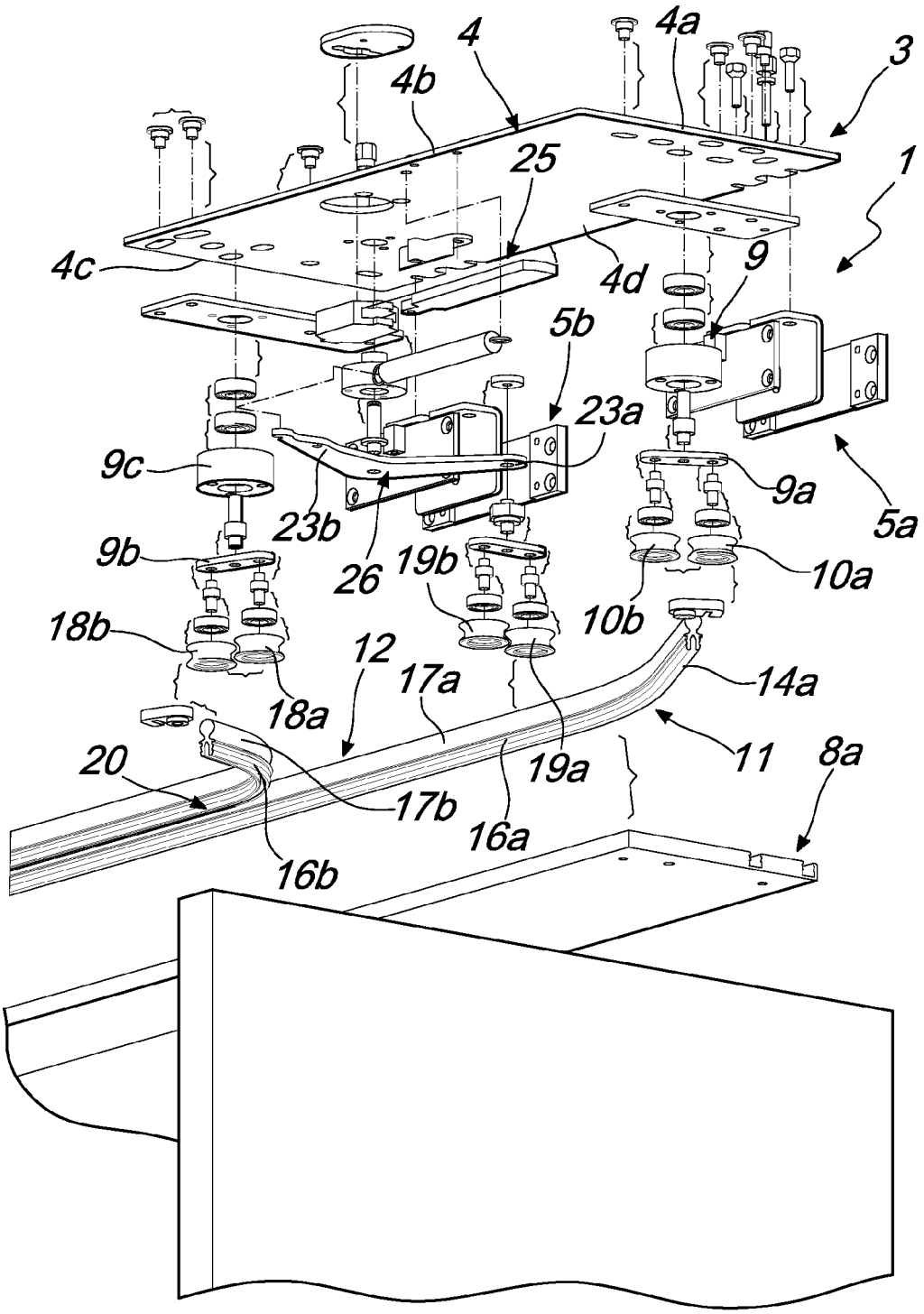
FIG. 4 is a second exploded perspective view, showing the device.
Figure 5:
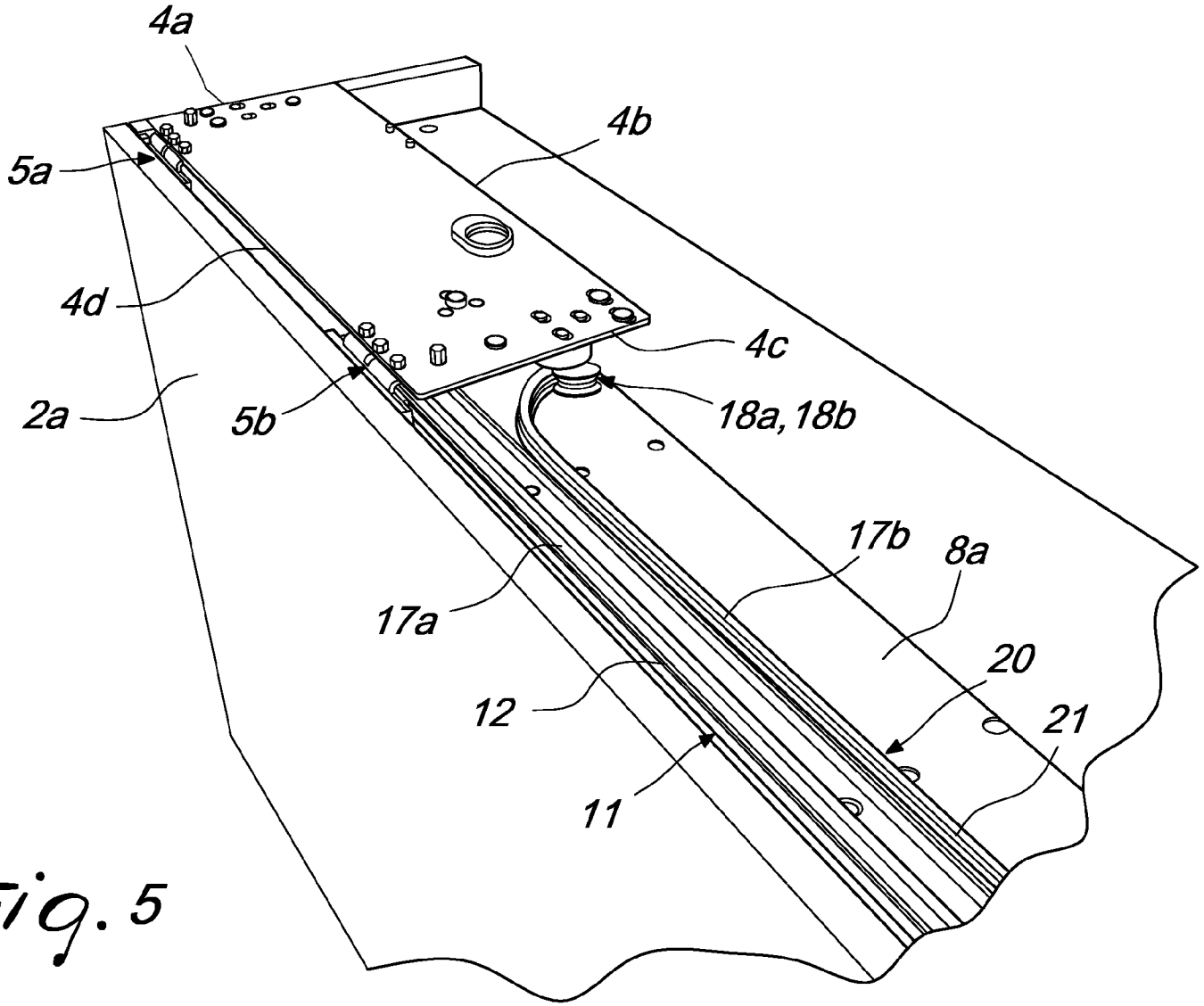
FIG. 5 shows a part of a piece of furniture in the condition with the door leaf closed.
Figure 6:
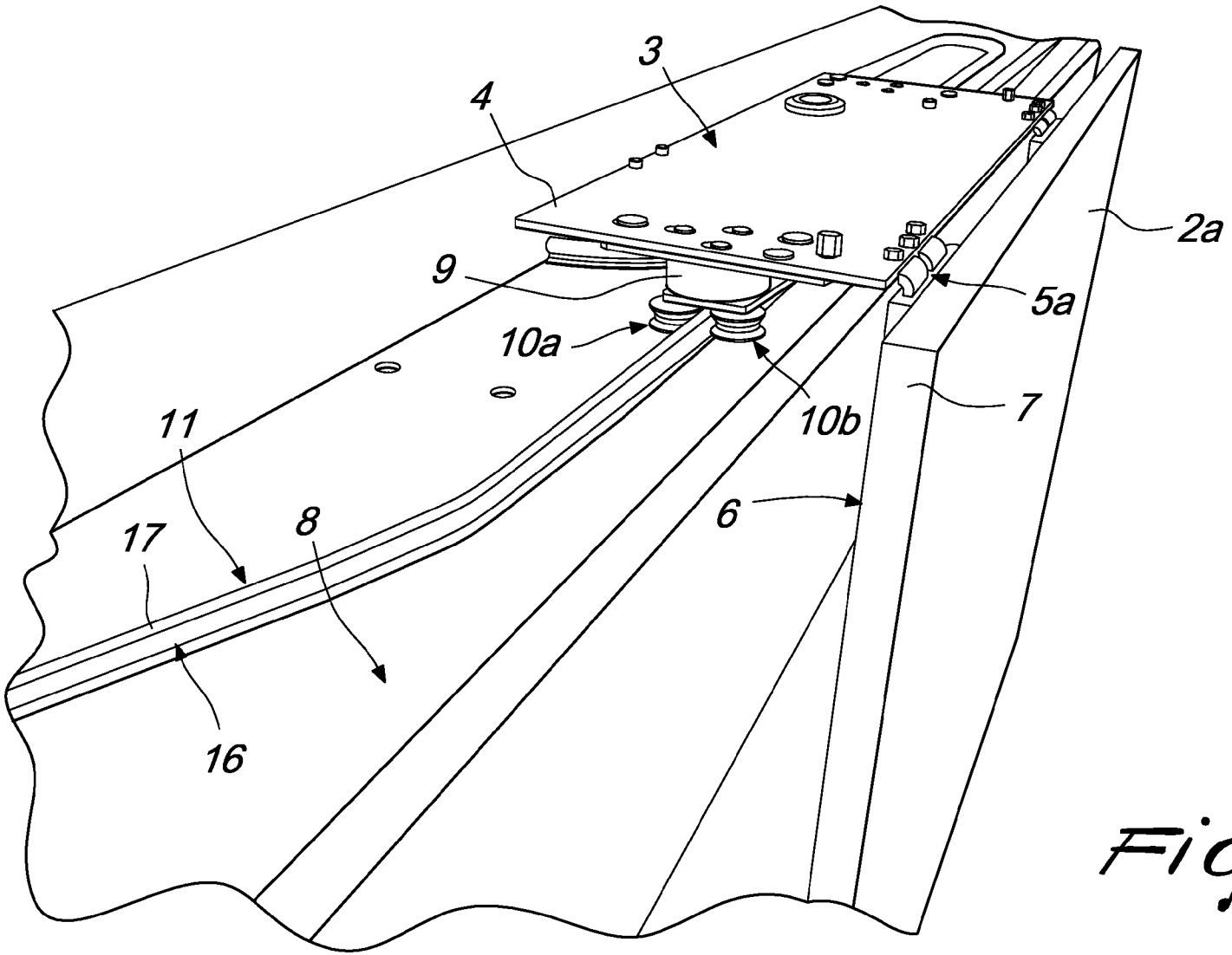
FIG. 6 shows a part of a piece of furniture in the condition with the door leaf open.
Figure 7:
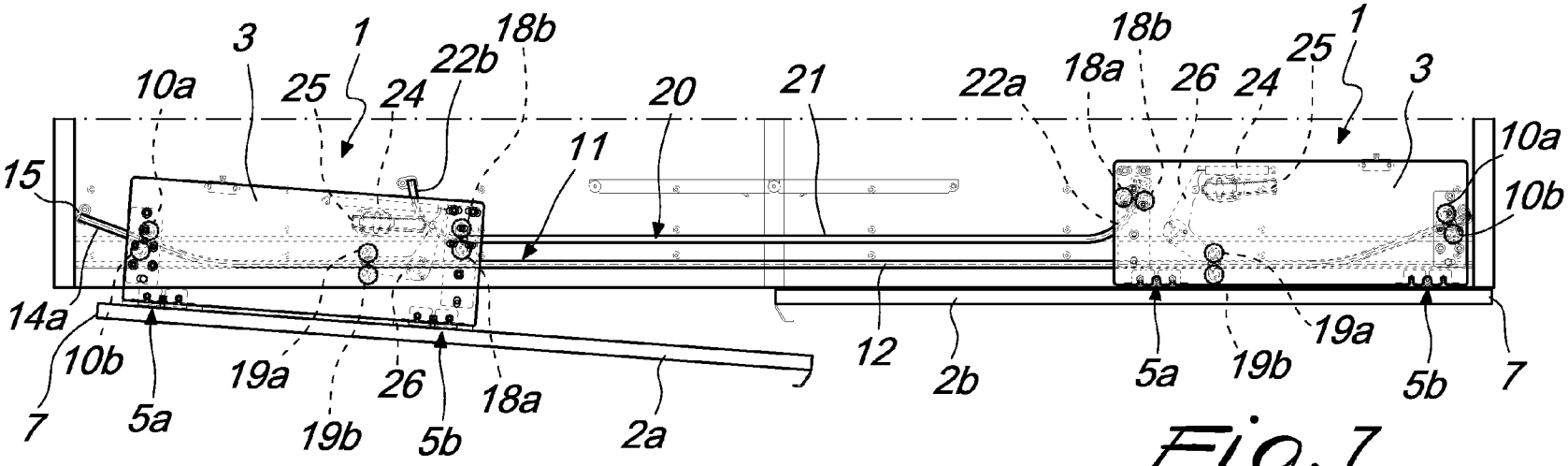
FIGS. 7 and 8 show the invention applied to a piece of furniture in the condition of initial opening of a door leaf and in the condition of a completely open door leaf.
Figure 8:
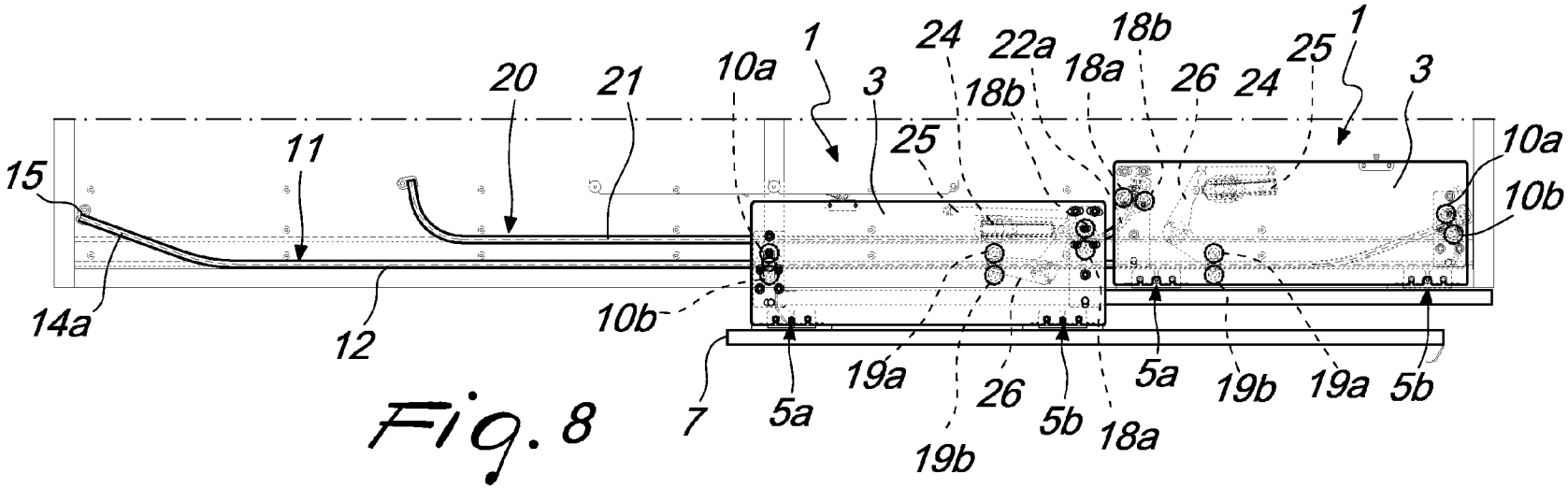

In the embodiments illustrated, individual characteristics shown in relation to specific examples may in reality be interchanged with other, different characteristics, existing in other embodiments.

Moreover, it should be noted that anything found to be already known during the patenting process is understood not to be claimed and to be the subject of a disclaimer.

With reference to the above figures, the reference numeral 1 generally designates a device for sliding door leaves 2*a* and 2*b* with co-planar closure, particularly for furniture and the like.

The device comprises a bracket system 3 for connection with each one of the door leaves 2*a* and 2*b*, composed of a flat plate 4, preferably rectangular in plan view, with which, at one of its longitudinal sides, a pair of L-shaped joints 5*a* and 5*b* are associated the wings of which are connected respectively to the plate 4 and to the inner lateral surface 6 of each door leaf 2*a* and 2*b* at the upper end thereof 7.

Rotatably associated with the surface of the plate 4 which faces, during use, the top 8 of the piece of furniture and is proximate to a central region of the first outer perimetric edge 4*a* of the plate 4, advantageously by means of the interposition of an adapted first cylindrical spacer or hub 9, is a first pair of wheels 10*a* and 10*b*, which are idle and arranged on a same surface parallel to the top 8 and are kept spaced apart by a desired space, which can be fixed or predetermined.

The rotatable interconnection of the first pair of wheels 10*a* and 10*b* is for example obtained by the use of an arm 9*a* that is pivoted centrally and in a downward region with respect to the first cylindrical spacer or hub 9 and at the ends of which the wheels are in turn pivoted and idle.

Adapted bearings and/or pads are provided in order to reduce friction.

The first pair of wheels 10*a* and 10*b* are slideably engaged with a first guide 11 that protrudes from a base 8*a* which is rendered integral with the top 8 of the piece of furniture, the first guide 11 being thus interposed in the space defined between the first pair of wheels 10*a* and 10*b*.

The first guide 11 is U-shaped in plan view so as to define a first portion 12 that is linear and approximately parallel to the front edge 13 of the piece of furniture, and two second portions 14*a* and 14*b* which are inclined in the direction of the rear edge 15 of the piece of furniture and the ends of which are adjacent to the side edges of the piece of furniture.

The inclination of the second portions 14*a* and 14*b* is such that the distance of the end 15 of the first guide 11 from the front edge 13 of the piece of furniture makes it possible to position the door leaves 2*a* and 2*b*, in the closed condition, right at the front edge 13 of the piece of furniture.

The length of the inclined portion is preferably, but not exclusively, slightly less than half of the length of the plate 4.

The first guide 11 is T-shaped in section so as to define a stein 16*a*, protruding from the base 8*a* associated with the piece of furniture and arranged approximately parallel to the front edge 13 of the piece of furniture, and a head 17*a* which is slideably locked between the grooves of the first pair of wheels 10*a* and 10*b*.

Associated with the bracket system 3 is a second pair of wheels 18*a* and 18*b* and a third pair of wheels 19*a* and 19*b*. The pair of second wheels 18*a* and 18*b* is similar to the first pair of wheels 10*a* and 10*b*.

The rotatable interconnection of the second pair of wheels 18*a* and 18*b* is also for example obtained by use of an arm 9*b* that is pivoted centrally and in a downward region with respect to a second cylindrical spacer or hub 9*c* and at the ends of which the wheels are in turn pivoted and idle.

The second pair of wheels 18*a* and 18*b* is positioned at the surface of the plate 4 which faces, during use, the base 8*a* associated with the top 8 of the piece of furniture and proximate to the longitudinal rear edge 4*b* of the plate 4, in the area of the corner of the plate 4 connecting the longitudinal rear edge 4*b* and the second outer edge 4*c*.

The second pair of wheels 18*a* and 18*b* is slideably engaged with a second guide 20, which is similar in shape to the first guide 11 but shorter. The second guide 20 is arranged parallel to the first guide 11 and is positioned in the direction opposite to the front edge 13 of the piece of furniture.

The second guide 20 is also T-shaped in section so as to also define a stein 16*b*, protruding from the base 8*a* associated with the top 8 of the piece of furniture and arranged approximately parallel to the front edge 13 of the piece of furniture, and a head 17*b* which is slideably locked between the grooves of the second pair of wheels 18*a* and 18*b*.

The distance that extends between the first and the second guides is such as to allow, in the open condition, the desired movement of the door leaf away from the front edge 13 of the piece of furniture.

In particular the shorter length of the second guide is, preferably but not exclusively, approximately equal to double the length of the plate 4 and this second guide 20 is also U-shaped in plan view so as to define a third portion 21 that is linear and approximately parallel to the front edge 13 of the piece of furniture, and two fourth portions 22*a* and 22*b*, which are arc-shaped and directed toward the rear edge 15 of the piece of furniture and shorter than the second portions 14*a* and 14*b*.

The inclination of the fourth portions 22*a* and 22*b* is such that in the condition with the door leaf closed the plate 4 is arranged horizontally and thus parallel to the first and second guides 11 and 20.

The first and second guides 11 and 20 are arranged approximately specularly with respect to a middle axis transverse to the top 8 of the piece of furniture.

Starting from the condition with the door leaves closed and coplanar, a movement imparted to one of the door leaves in order to achieve the opening thereof involves an initial movement of the plate 4 toward the front edge 13 of the piece of furniture. In particular, the shape of the second guide 20 ensures that the second pair of wheels 18*a* and 18*b*, which support the door leaf thanks to their slideable engagement with the head 17*a* and 17*b*, forces the movement of the plate and thus of the door leaf outward from the piece of furniture.

This movement is immediately accentuated thanks to the shape of the fourth portions 22*a* and 22*b*.

The different inclination of the second portions 14*a* and 14*b* of the first guide 11 with respect to the fourth portions of the second guide 20 imposes, in the first step of opening, an initial, inclined arrangement on the plate 4 and thus on the door leaf, until it is brought to the horizontal condition when the first and second pairs of wheels 18*a*, 18*b*, 19*a* and 19*b* are arranged on the first and on the third portion 12 and 21 of the first and second guides 11 and 20.

The third pair of wheels 19*a* and 19*b* is positioned at the surface of the plate 4 which faces, during use, the base 8*a* associated with the top 8 of the piece of furniture and proximate to the longitudinal front edge 4*d* of the plate 4 which is adjacent to the front edge 13 of the piece of furniture, in an area facing the adjacent second outer perimetric edge 4*c* of the plate 4.

The third pair of wheels 19*a* and 19*b* is also arranged on a same surface parallel to the top 8, it rests on the head 17*a* which is advantageously slideably locked between the grooves of the third pair of wheels 19*a* and 19*b*.

The third pair of wheels 19*a* and 19*b* is rotationally connected with means adapted to force the closure arrangement of at least one of the door leaves.

Such means are constituted by a V-shaped linkage 26, a first end 23*a* of which is pivoted to the third pair of wheels 19*a* and 19*b* and the vertex of which, directed away from the second pair of wheels 19*a* and 19*b*, is pivoted to the plate 4.

The second end 23*b* of the linkage 26 is engaged with an element which can be elastically elongated, such as a spring 24 whose other end is coupled to the plate 4.

In the condition with the door leaf closed the spring 24 is unloaded.

A unidirectional brake or actuator 25 is engaged, along the same direction as said spring 24, between the vertex and the second end 23*b* of the linkage 26, whose function it is to work only during closing of the door leaf, so as to slow down its stroke during repositioning in a co-planar condition and reduce sudden closing movements.

In practice it has been found that the invention has fully achieved the intended aim and objects, a device having been obtained that, applied to sliding doors, makes it possible to achieve a gradual final closure of the door which is pulled slowly, in the last portion of its closing movement, by the device until it is gently brought up against the piece of furniture.

The device moreover requires no intervention from the user, who can thus apply less force to the door leaf which, when it is proximate to complete closure, is shifted thanks to the presence of the spring 24, which was previously elongated during opening. The presence of the brake 25 lastly slows down the final approach of the door leaf against the piece of furniture.

Obviously the materials used as well as the dimensions constituting the individual components of the invention can be more pertinent to specific requirements.

The various means for effecting certain different functions shall not in any way coexist only in the illustrated embodiment, but may be present per se in many embodiments, even if they are not illustrated.

The characteristics indicated as advantageous, convenient or similar may also be missing or be substituted by equivalent characteristics.

The disclosures in Italian Patent Application No. TV2011A000071 from which this application claims priority are incorporated herein by reference.

The invention claimed is:

1. A device for sliding door leaves with co-planar closure of said door leaves, the device comprising elements adapted to force a closure arrangement of at least one of said door leaves, wherein said elements adapted to force the closure arrangement of at least one of said door leaves comprise at least one linkage, which is V-shaped and which has a vertex, a first end, and a second end, the second end interacting with at least one spring element which can be elastically elongated and at least one unidirectional brake or actuator being engaged between said vertex and said second end, the device further comprising a bracket system composed of a flat plate with which a pair of L-shaped joints are associated at a longitudinal side thereof, wings of said joints being connected respectively to said plate and to an inner lateral surface of each one of said door leaves, a first pair of wheels being associated rotatable and in a lower region with said plate.

2. The device according to claim 1, wherein said at least one linkage has a first end which is pivoted to a third pair of wheels, which are similar to said first pair of wheels and are slideably engaged with an underlying first guide, which is arc-shaped in plain view and protrudes from a top of a piece of furniture.

3. The device according to claim 2, wherein the vertex of said at least one linkage is directed away from said third pair of wheels and is pivoted to said plate, the second end of said linkage being engaged with said at least one spring element which can be elastically elongated, whose other end is coupled to said plate, said spring element being unloaded in a condition in which the door leafs are closed.

4. The device according to claim 3, wherein said at least one unidirectional brake or actuator is engaged, along a same direction as said at least one spring element, between said vertex and said second end of said linkage for working only during closing of the door leafs, so as to slow down a stroke of the door leafs during repositioning in a co-planar condition and reduce sudden closing movements.

* * * * *

UNITED STATES PATENT AND TRADEMARK OFFICE

CERTIFICATE OF CORRECTION

PATENT NO. : 9,157,264 B2
APPLICATION NO. : 14/119064
DATED : October 13, 2015
INVENTOR(S) : Guido Bortoluzzi et al.

It is certified that error appears in the above-identified patent and that said Letters Patent is hereby corrected as shown below:

In the Specification:

Column 3, line 43, replace "stein" with --stem--; and

Column 4, line 2, replace "stein" with --stem--.

Signed and Sealed this
Eighth Day of March, 2016

Michelle K. Lee

Michelle K. Lee
*Director of the United States Patent and Trademark Office*